US009898031B1

(12) United States Patent
Wurzer et al.

(10) Patent No.: US 9,898,031 B1
(45) Date of Patent: Feb. 20, 2018

(54) CLUTCH PEDAL EXTENDER

(71) Applicants: Adam J. Wurzer, Carroll, IA (US); Terry D. Wurzer, Panora, IA (US); David T. Wurzer, Carroll, IA (US)

(72) Inventors: Adam J. Wurzer, Carroll, IA (US); Terry D. Wurzer, Panora, IA (US); David T. Wurzer, Carroll, IA (US)

( * ) Notice: Subject to any disclaimer, the term of this patent is extended or adjusted under 35 U.S.C. 154(b) by 0 days.

(21) Appl. No.: 14/689,468

(22) Filed: Apr. 17, 2015

(51) Int. Cl.
*G05G 1/48* (2008.04)
*G05G 1/487* (2008.04)

(52) U.S. Cl.
CPC ..... *G05G 1/487* (2013.01)

(58) Field of Classification Search
CPC ..... G05G 1/487
USPC ..... 74/562
See application file for complete search history.

(56) References Cited

U.S. PATENT DOCUMENTS 1,213,824 A * 1/1917 Bloom ..... G05G 1/487 74/562
1,293,101 A * 2/1919 Hughes ..... G05G 1/487 74/562
1,328,400 A * 1/1920 Reich ..... G05G 1/487 74/562
1,346,361 A * 7/1920 Williams ..... G05G 1/487 74/562
1,484,847 A * 2/1924 Stuart ..... G05G 1/405 74/562
1,556,921 A * 10/1925 Emerson ..... G05G 1/40 74/562
2,078,324 A * 4/1937 Griffiths ..... B60W 10/18 74/478
5,839,326 A * 11/1998 Song ..... B60T 7/06 403/104
6,131,485 A * 10/2000 Raja ..... G05G 1/487 180/334

FOREIGN PATENT DOCUMENTS

DE 2045451 A1 * 3/1972 ..... B60K 26/02

OTHER PUBLICATIONS

DE 2045451 A1 translation.*

* cited by examiner

*Primary Examiner* — Vicky A Johnson
(74) *Attorney, Agent, or Firm* — Dennis L. Thomte; Thomte Patent Law Office LLC

(57) ABSTRACT

A clutch extender which is positioned between the free end of a clutch pedal arm and a clutch pedal.

1 Claim, 5 Drawing Sheets

CLUTCH PEDAL EXTENDER

BACKGROUND OF THE INVENTION

Field of the Invention

This invention relates to a clutch pedal extender and more particularly to an extender for a clutch pedal which enables a driver to more easily and effectively depress the clutch pedal to enable the driver to shift gears.

Description of the Related Art

Most large trucks such as those manufactured by Peterbuilt, Sterling, Mack, etc. utilize manual transmissions which require the use of a clutch pedal which must be depressed to enable the driver to shift gears. In some cases, such as in certain Peterbuilt trucks, the clutch pedal must be completely depressed to the floor of the truck before the shifting operation may be accomplished. Since the clutch pedal is rigidly connected to the clutch pedal arm, the inwardly and downwardly movement of the clutch pedal during the clutching action requires the driver to pronate his or her ankle during the downward and inward movement of the clutch pedal. The clutching action is made even more difficult when the driver's seat is in its most rearward position to accommodate larger drivers.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The method and means is disclosed for extending a clutch pedal which is connected to a clutch pedal arm. The method steps of extending the clutch pedal are: (a) removing the clutch pedal from the upper end of the clutch pedal arm; (b) providing an elongated clutch pedal extender having an inner end and an outer end; (c) securing the inner end of the clutch pedal extender to the upper end of the clutch pedal arm; and (d) securing the outer end of the clutch pedal extender to the clutch pedal.

The means of extending the clutch pedal involves the use of an elongated clutch pedal extender which includes an elongated body member having an inner end, an outer end, an upper side, a lower side, a first side and a second side. The inner end of the body member has a pair of spaced-apart first and second ears or fingers extending therefrom with each of the first and second fingers having a bolt opening formed therein. The outer end of the body member has a third ear or finger extending therefrom which also has a bolt opening formed therein.

The first and second fingers of the body member are secured to the upper end of the clutch pedal arm by a bolt extending through the bolt openings in the first and second fingers and through the bolt opening in the upper end of the clutch pedal arm. The third finger of the body member is secured to first and second brackets of the clutch pedal by a bolt extending through the bolt openings in the first and second brackets and through the bolt opening in the third finger of the body member.

A principal object of the invention is to provide a clutch extender for a vehicle.

A further object of the invention is to provide a clutch extender which is easily installed between the clutch pedal and the clutch pedal arm.

A further object of the invention is to provide a clutch extender which eliminates the need for the clutch pedal to be completely extended to the floor of the vehicle during the clutching action.

A further object of the invention is to provide clutch extender which is economical of manufacture, durable in use, and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
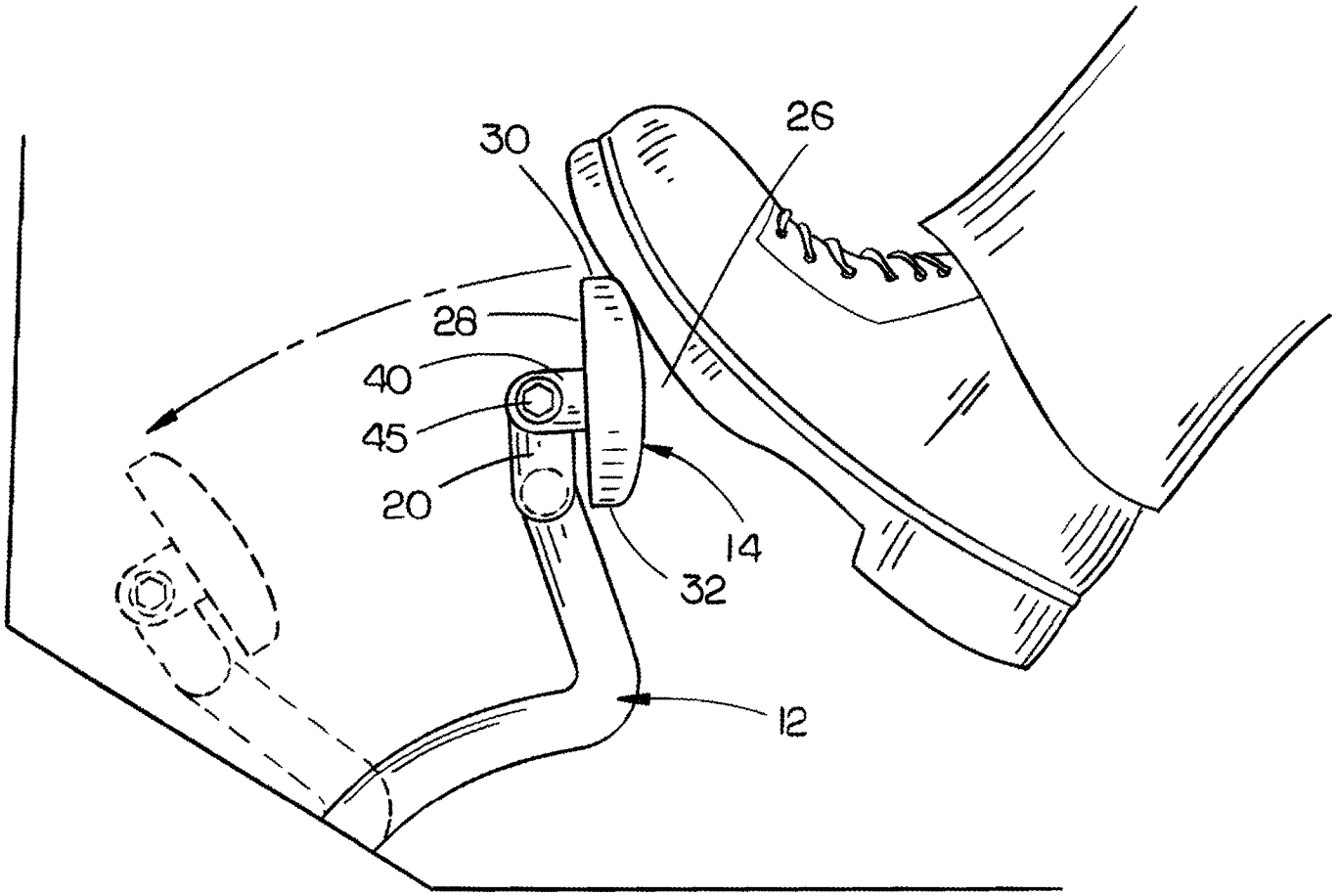
FIG. 1 (PRIOR ART)
FIG. 1 is a side view of a prior art clutch.
Figure 2:
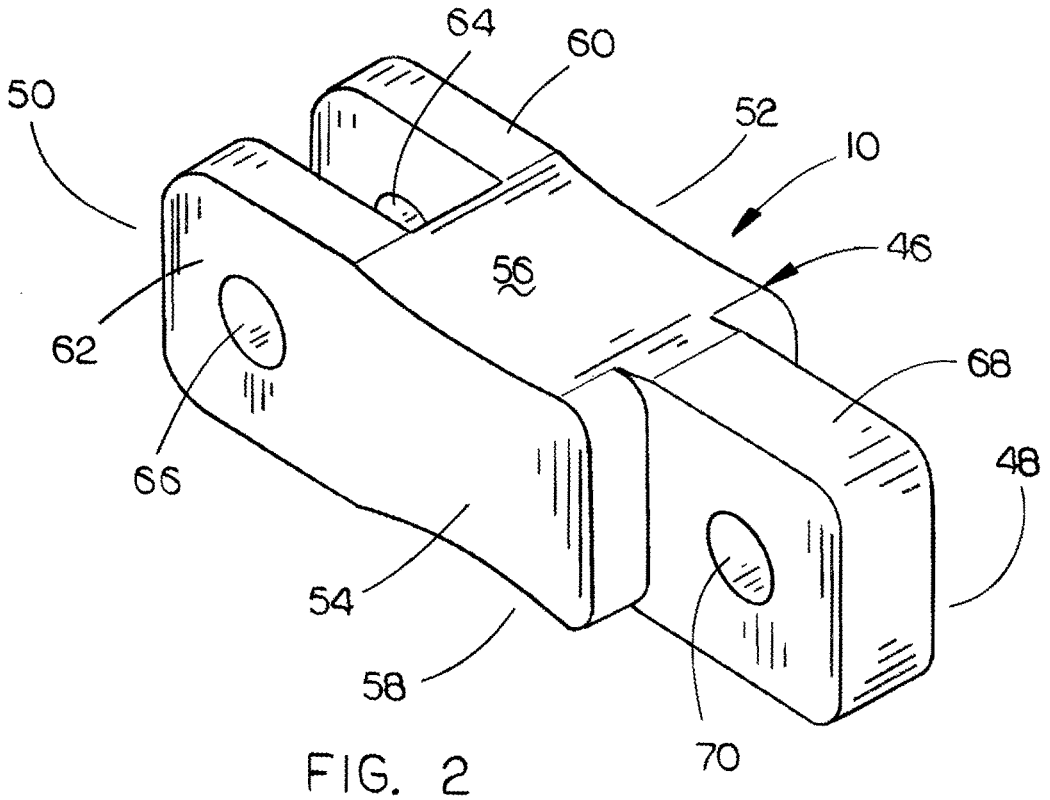
FIG. 2 is a perspective view of the clutch extender of this invention.
Figure 3:
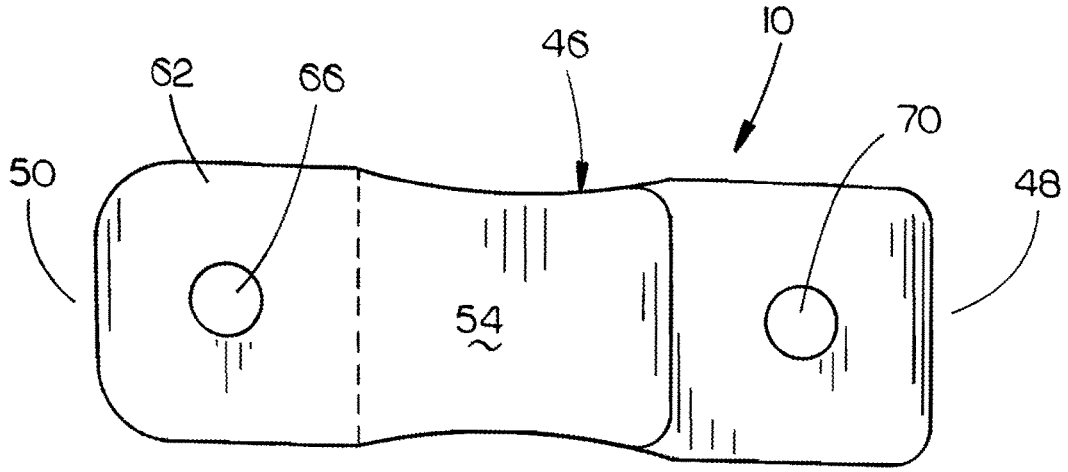
FIG. 3 is a side view of the extender of FIG. 2.
Figure 4:
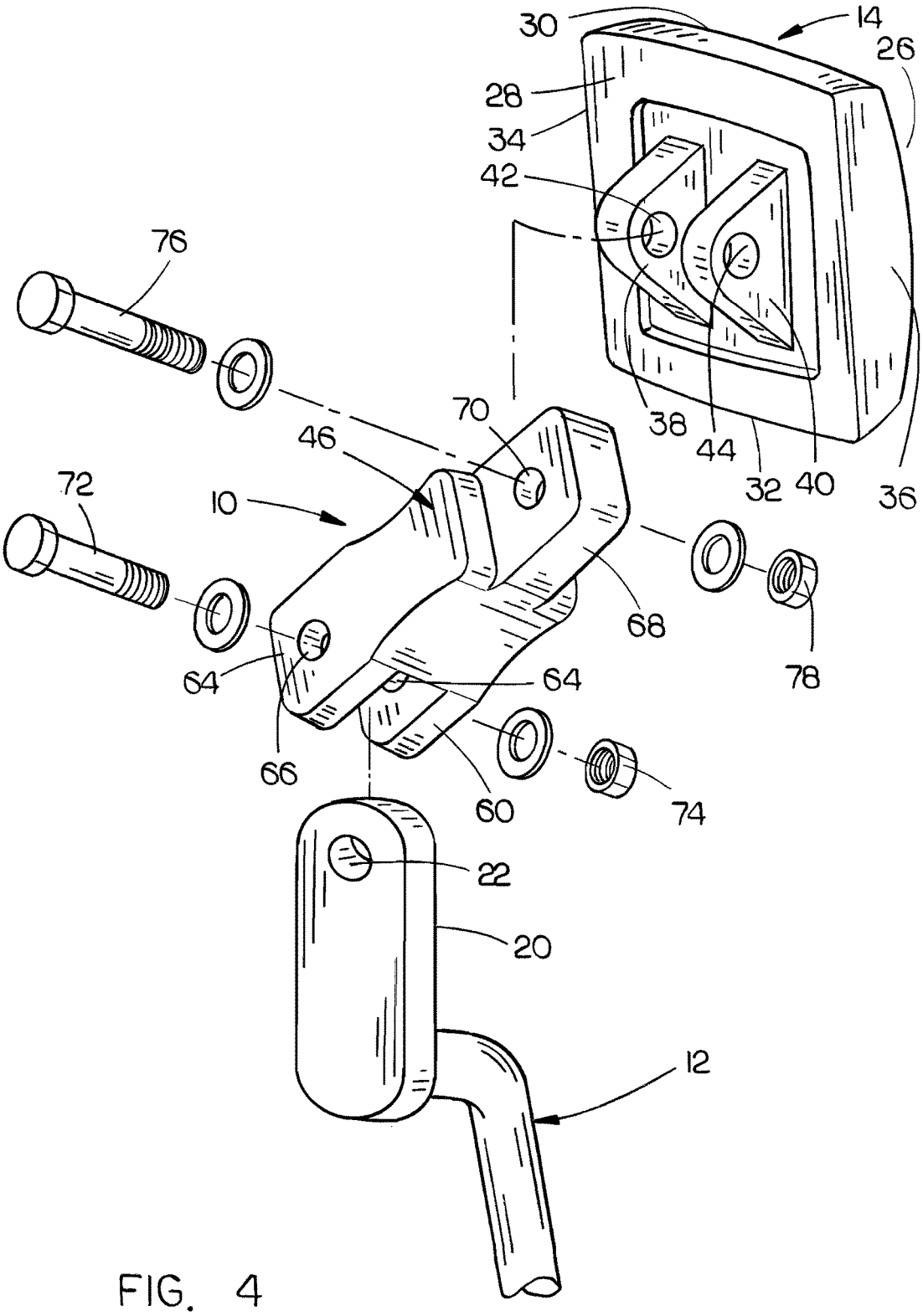
FIG. 4 is an exploded perspective view of the clutch pedal arm, the clutch extender, and the clutch pedal.
Figure 5:
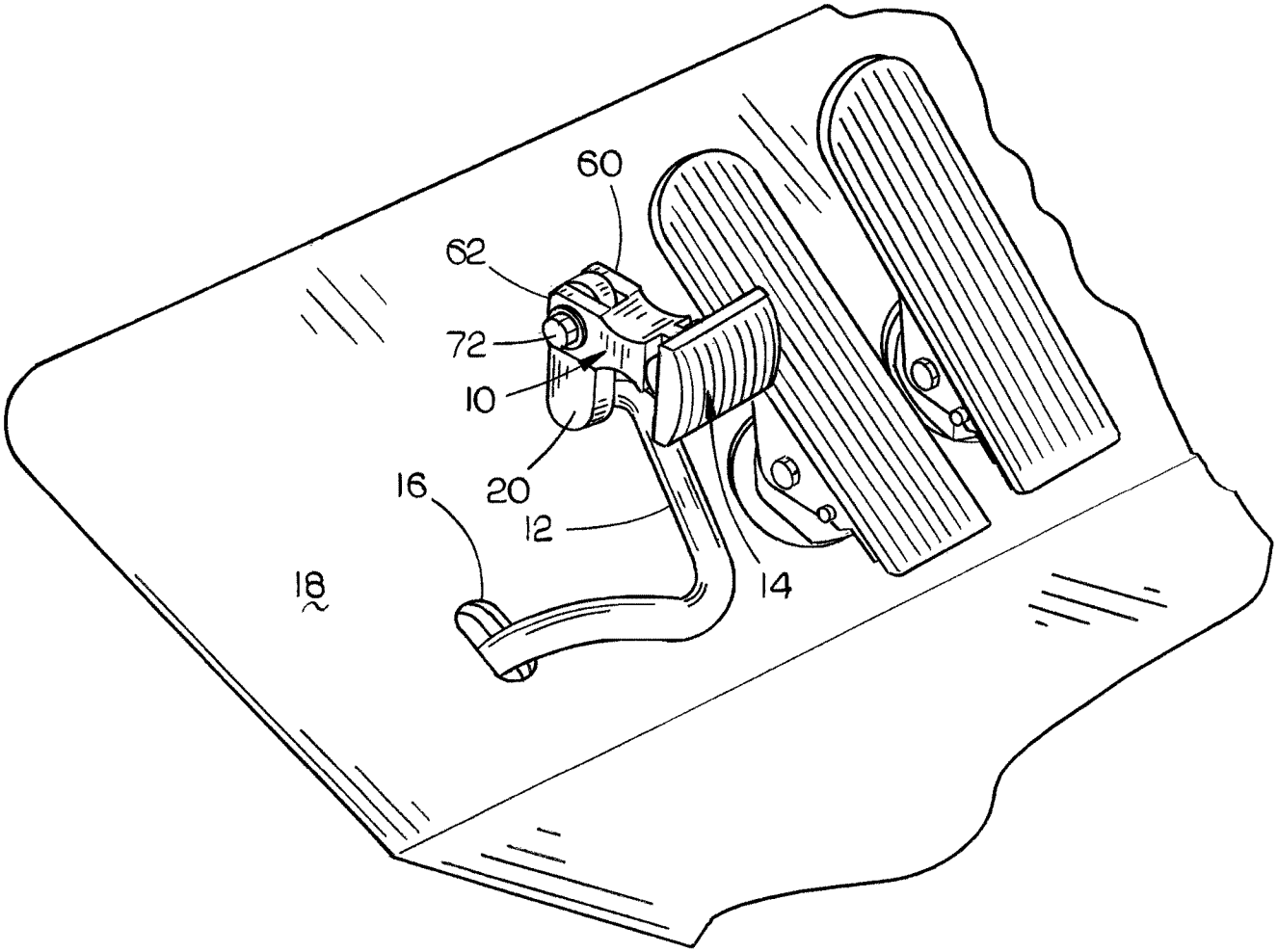
FIG. 5 is a perspective view illustrating the clutch extender positioned between the clutch pedal arm and the clutch pedal.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the clutch extender of this invention which is designed to be used between a clutch pedal arm 12 and a clutch pedal 14 which are associated with a clutch of a vehicle such as a truck or the like. The prior art clutch pedal arm 12 may take many shapes such as that shown in the drawings. For example, the clutch pedal arm 12 may movably extend upwardly from the clutch of the vehicle through an opening 16 in the floor board 18 of the vehicle. The clutch pedal arm 12 disclosed herein has an upstanding plate 20 secured thereto which has a bolt opening 22 formed therein. The conventional clutch pedal 14 has an outer side 26, an inner side 28, an upper end 30, a lower end 32, a first side 34 and a second side 36. The inner side 28 of clutch pedal 24 has a pair of ears or brackets 38 and 40 extending therefrom. Brackets 38 and 40 have bolt openings 42 and 44 formed therein respectively. Normally, clutch pedal 14 is secured to clutch pedal arm 12 by a bolt 45 extending through bolt opening 44 in bracket 40, through bolt opening 22 in plate 20 and through bolt opening 42 in bracket 38. A nut is secured to the threaded end of the bolt 45.

As seen in FIG. 1, if the clutch pedal 14 is depressed to the broken line positioning FIG. 1, the ankle of the driver's foot must be pronated to fully depress the clutch pedal 14 so that the driver may shift gears.

Clutch extender 10 includes an elongated body member 46 having an outer end 48, an inner end 50, a first side 52, a second side 54, an upper end 56 and a lower end 58. Body member 46 includes a pair of spaced-apart ears or fingers 60 and 62 which extend therefrom. Ears 60 and 62 have bolt openings 64 and 66 formed therein respectively. Body member 46 also has an ear or finger 68 extending outwardly from its outer end 48. Ear 68 has a bolt opening 70 formed therein.

To extend the clutch pedal 14 from the clutch pedal arm 12, the bolt 45 is removed so that clutch pedal 14 may be disconnected from plate 20. The ears 60 and 62 are then positioned so that the plate 20 is received there between. A bolt 72 is then extended through bolt opening 66 in ear 62, through bolt opening 22 in plate 20 of clutch pedal arm 12 and through bolt opening 64 in ear 60. A nut 74 is secured to the threaded end of bolt 72 to rigidly connect plate 20 to body member 46.

Figure 6:
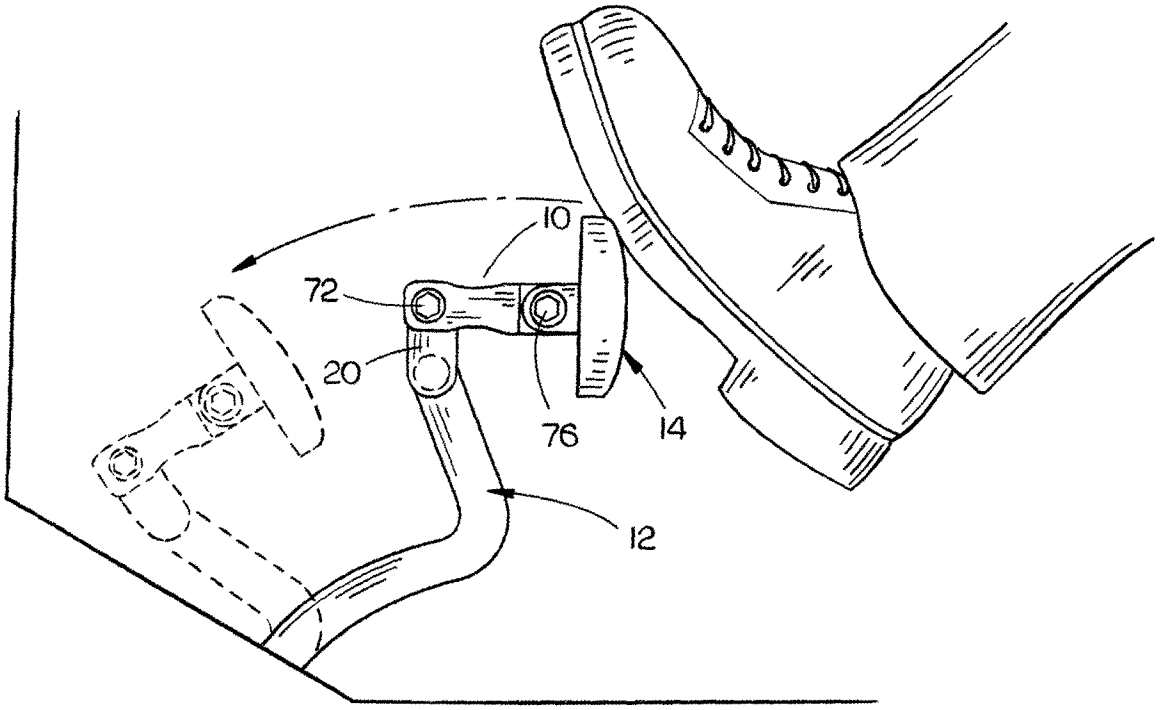
FIG. 6 is a side view of the clutch extender positioned between the clutch pedal arm and the clutch pedal.

The clutch pedal 14 is then secured to the outer end of body member 46 by positioning the clutch pedal 14 with respect to body member 46 so that ear 68 of body member 46 is received between ears 38 and 40 of clutch pedal 14. A bolt 76 is then extended through bolt opening 44 of ear 40, through bolt opening 70 of ear 68 and through bolt opening 42 in ear 38. A nut 74 is loosely threaded onto the threaded end of bolt 72. Pedal 14 is then pivoted to the desired position with respect to body portion 46 such as seen in FIG. 6. The nut 78 is tightened to rigidly secure pedal 14 to body portion 46 of extender 10.

As seen in FIG. 6, the clutch extender 10 permits the clutch pedal arm 12 to be moved inwardly to the broken line position without the need for the driver's ankle to be pronated to the degree of FIG. 1.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. In combination:

an elongated clutch pedal arm movably supported on a vehicle;

said clutch pedal arm having an upper end with a horizontally disposed bolt opening which is transversely disposed with respect to said clutch pedal arm;

a clutch pedal extender, comprising:

(a) an elongated body member having an inner end, an outer end, an upper side, a lower side, a first side and a second side;

(b) said inner end of said body member having spaced-apart first and second fingers extending therefrom with each of said first and second fingers having a bolt opening formed therein;

(c) said outer end of said body member having a third finger extending outwardly therefrom;

(d) said third finger having a bolt opening formed therein;

(e) a first bolt extending through said bolt opening in said first finger, through said bolt opening in said upper end of said clutch pedal arm and through said bolt opening in said second finger;

(f) a first nut threadably secured to said first bolt outwardly of said second finger;

(g) said first nut being threadably movably mounted on said first bolt between a first untightened position and a second tightened position on said first bolt;

(h) said first nut, when in said first untightened position on said first bolt, permitting said body member to be freely pivoted with respect to said clutch pedal arm to a desired position;

(i) said first nut, when in second tightened position on said first bolt, preventing pivotal movement of said body member with respect to said clutch pedal arm thereby maintaining said body member in said desired position with respect to said clutch pedal arm;

a clutch pedal having inner and outer sides with first and second spaced-apart brackets extending from said inner side of said clutch pedal;

each of said first and second brackets having a bolt opening formed therein;

said third finger of said body member being received between said first and second brackets of said clutch pedal so that said bolt opening in said third finger registers with said bolt openings in said first and second brackets of said clutch pedal;

a second bolt having a head end and a threaded end;

said threaded end of said second bolt extending through said bolt opening in said first bracket of said clutch pedal, through said bolt opening in said third finger and through said bolt opening in said second bracket of said clutch pedal;

a second nut threadably mounted on said second bolt to attach said third finger of said body member to said first and second brackets of said clutch pedal;

said second nut being threadably movably mounted on said second bolt between a first untightened position and a second tightened position on said second bolt;

said second nut, when in said first untightened position on said second bolt, permitting said clutch pedal to be freely pivoted with respect to said body member; and said second nut, when in said second tightened position on said second bolt, preventing pivotal movement of said clutch pedal with respect to said body member thereby maintaining said clutch pedal in said desired position with respect to said body member.

* * * * *